US006669384B2

(12) United States Patent
Furuya et al.

(10) Patent No.: US 6,669,384 B2
(45) Date of Patent: Dec. 30, 2003

(54) PRINTING APPARATUS

(75) Inventors: Nobuyuki Furuya, Ibaraki (JP); Sadanori Kobashi, Ibaraki (JP); Yoshihiko Sano, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/189,596

(22) Filed: Jul. 8, 2002

(65) Prior Publication Data

US 2003/0063940 A1 Apr. 3, 2003

(30) Foreign Application Priority Data

Sep. 28, 2001 (JP) ..... P.2001-301393

(51) Int. Cl.[7] ..... B65H 29/00

(52) U.S. Cl. ..... 400/624; 400/578; 400/710; 270/58.01; 270/58.09

(58) Field of Search ..... 400/624, 578, 400/703, 710; 270/58.01, 58.09, 58.08, 58.07

(56) References Cited

U.S. PATENT DOCUMENTS 5,449,157 A * 9/1995 Kawano et al. ..... 270/58.11
5,938,192 A * 8/1999 Kosasa ..... 271/221
6,168,145 B1 * 1/2001 Tanaka et al. ..... 270/58.11
6,337,970 B1 * 1/2002 Okamoto et al. ..... 399/407

FOREIGN PATENT DOCUMENTS

JP 07157178 A * 6/1995 ..... B65H/37/04

* cited by examiner

*Primary Examiner*—Andrew H. Hirshfeld
*Assistant Examiner*—Dave A. Ghatt
(74) *Attorney, Agent, or Firm*—McGinn & Gibb, PLLC

(57) ABSTRACT

In a printing apparatus in which a sheet handling device for conducting plural kinds of post processing is connected to a subsequent stage of an image forming device, a plurality of sheet feeding apparatuses disposed in the sheet handling device have a sheet residual amount detecting sensor and a sheet exhaustion detecting sensor. When the sheet residual amount detecting sensor detects that the number of sheets in an inserter is smaller than a predetermined number, the image forming device transports a sheet after it is confirmed by the sheet exhaustion detecting sensor that a sheet remains in the inserter.

19 Claims, 3 Drawing Sheets

PRINTING APPARATUS

BACKGROUND OF THE INVENTION

Field of the Invention

The present invention relates to a printing apparatus in which a sheet handling device is connected to a subsequent stage of an image forming device typified by a printer, a copier, and the like.

An image forming device has been practically used in which a sheet handling device typified by, for example, a finisher comprising a post processing apparatus such as a stacker having a sheet tray or a stapler is connected to a subsequent stage of an image forming device typified by a printer, a copier, and the like, thereby improving the handleability of printed sheets, the working efficiency, etc.

The sheet handling device has a post processing function such as a stapler or a sheet folding blade. Sheets transported from the image forming device are further transported to and aligned in a stacking tray having a function of stacking and aligning sheets. When the number of stacked sheets reaches a prescribed number, the bundle of the sheets is stitched at a middle position. The stitched bundle of sheets is transported to a folding machine which folds a bundle of sheets in two. The folding machine folds the bundle of sheets in two by using the stitched position as a reference, to produce a booklet.

Hereinafter, the process of stitching a middle position of a bundle of sheets and folding in two the bundle of sheets at the stitched position is referred to as "saddle-stitching and folding process".

Alternatively, another post processing apparatus may be connected to the subsequent stage of the sheet handling device, so that a sheet transported from the image forming device is passed through the above-mentioned stacking tray and then discharged to the post processing apparatus connected to the subsequent stage of the sheet handling device.

In the sheet handling device, also a sheet feeding apparatus (inserter) may be mounted. In this case, the sheet handling device has a mechanism in which a sheet fed from the inserter enters a sheet transporting path in front of the stacking tray, so that the sheet fed from the inserter can be inserted into sheets transported from the image forming device.

In the case where the saddle-stitching and folding process is to be conducted by using such an inserter, when a sheet is fed from the inserter at a timing when the sheet is transported to the stacking tray in advance of sheets transported from the image forming device, the bundle of sheets which has undergone the saddle-stitching and folding process is formed as a booklet in which the sheet fed from the inserter is used as a cover.

In the case where sheets are to be discharged by using the inserter to the post processing apparatus connected to the subsequent stage of the sheet handling device, when colored sheets (in this case, the color is different from that of sheets transported from the image forming device) are housed in the inserter and the sheets of the inserter are inserted into those which are transported from the image forming device and being transported in the sheet handling device, the sheets which are discharged to and stacked in the post processing apparatus are partitioned by the colored sheets fed from the inserter. Hereinafter, the process of inserting a sheet(s) into sheets to partition the sheets is referred to as "sheet inserting process".

In a system in which an image forming device is connected to such a sheet handling device, when the saddle-stitching and folding process is to be conducted by using an inserter, the image forming device starts the operation of feeding sheets from a sheet housing section, in consideration of the time period required for a sheet fed from the inserter to be discharged to a stacking tray. In this case, the saddle-stitching and folding process or the sheet inserting process is conducted while the interval between the sheet fed from the inserter and sheets fed from the image forming device is set to be as small as possible, thereby improving the productivity. In the case where the saddle-stitching and folding process or the sheet inserting process is conducted by using an inserter, therefore, it is usual that sheets are first transported from the image forming device and a sheet is then transported from the inserter.

The image forming device transports sheets before a sheet fed from the inserter is discharged to the stacking tray or the post processing apparatus in the subsequent stage of the sheet handling device. At the timing when the last sheet of the inserter is fed and it is detected that there is no sheet in the inserter, therefore, a plurality of sheets already exist in the image forming device. In the case where the saddle-stitching and folding process or the sheet inserting process is to be conducted, therefore, the several sheets fail to contain a sheet from the inserter which is to be subjected together with the sheets to the process. As a result, the saddle-stitching and folding process or the sheet inserting process cannot be conducted, and the sheets remain in the image forming device, thereby causing a problem in that the remaining sheets must be removed away.

SUMMARY OF THE INVENTION

The present invention has been made to solve the above problem with the conventional art.

The problem can be solved by a configuration wherein, in a state where the number of sheets in an inserter of an sheet handling device is detected to be smaller than a predetermined number by using a sheet residual amount detecting sensor for detecting that the number of sheets in the inserter is smaller than a certain reference number, a timing of transporting a sheet from an image forming device is changed in accordance with the state of the sheet residual amount detecting sensor so that, after a sheet fed from the inserter is discharged to a stacking tray or a post processing apparatus in a subsequent stage of the sheet handling device, a sheet is transported from the image forming device.

DETAILED DESCRIPTION OF THE PREFERRED EMBODIMENTS

Figure 1:
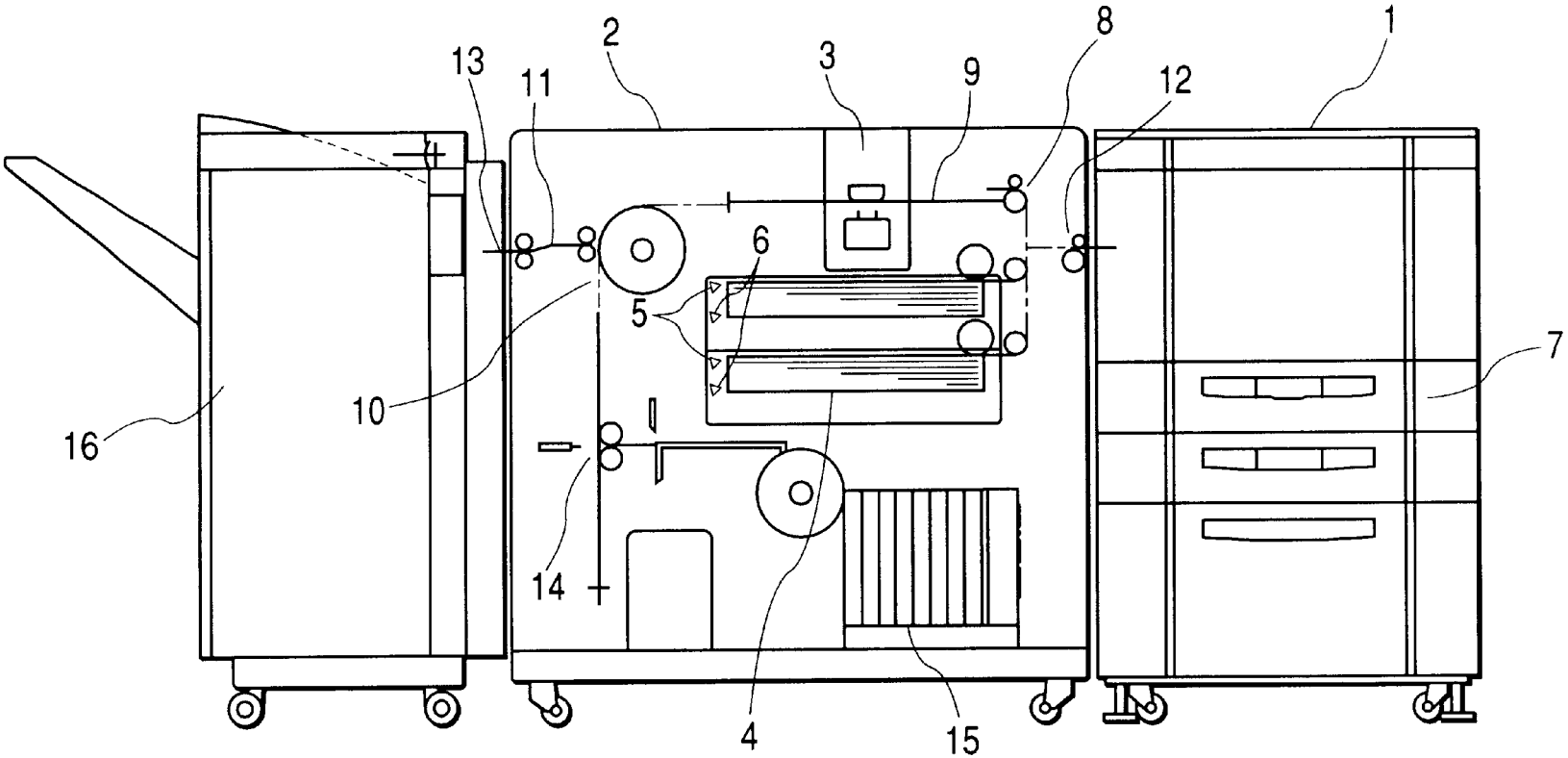
FIG. 1 is a diagram of a printing apparatus of an embodiment of the invention and having an image forming device and a sheet handling device.

Now, a description will be given in more detail of preferred embodiments of the invention with reference to the accompanying drawings.

A sheet handling device 2 of an embodiment is connected to a subsequent stage of an image forming device 1, i.e., to the downstream side in a sheet transporting direction, and has a post processing function such as a stapler or a sheet folding blade. By virtue of this function, the sheet handling device can conduct a process of producing a booklet (hereinafter, such a process is referred to as saddle-stitching and folding process, and its detail will be described later). Furthermore, one of post processing apparatuses 16 of different kinds can be connected to the subsequent stage of the sheet handling device 2, and a process of passing a sheet transported from the image forming device 1 through the sheet handling device 2 and then transporting the sheet to the post processing apparatus 16 (hereinafter, such a process is referred to as passing process, and its detail will be described later) can be conducted.

First, the saddle-stitching and folding process of the sheet handling device 2 will be described. Sheets transported from the image forming device 1 are transported into a sheet inlet port 12 of the sheet handling device 2, passed through a sheet inlet port transporting path 9, and then transported to a stacking tray 3. The sheets transported to the stacking tray 3 are aligned in the longitudinal and lateral directions. When the number of sheets stacked on the stacking tray 3 reaches a number indicated by the image forming device 1, staplers which are mounted respectively in two or front and inner places above the stacking tray 3 stitch the sheets at a middle position in the sheet transporting direction. The stitched sheets are transported from the stacking tray 3 to a folding machine 14 with being passed through a folding section transporting path 10. The sheets are folded in two by using the stitched position as a reference, by the sheet folding blade mounted in the folding machine 14, and then discharged as a booklet to a booklet discharge port 15.

Next, the passing process of the sheet handling device 2 will be described. Sheets transported from the image forming device 1 are transported into the sheet inlet port 12 of the sheet handling device 2, passed through the sheet inlet port transporting path 9 and the stacking tray 3, passed through a sheet discharging section transporting path 11, and then transported to the post processing apparatus 16 from a sheet discharge port 13.

An apparatus which feeds a sheet (hereinafter, such an apparatus is referred to as inserter 4) can be additionally disposed in the sheet handling device 2. The inserter 4 has a function of inserting a fed sheet from a sheet junction 8 into the sheet inlet port transporting path 9.

A stack of sheets of a height of about 5 cm at the maximum can be loaded in the inserter 4. A sheet residual amount detecting sensor 5 for detecting that the amount of loaded sheets becomes 10% or less, and a sheet exhaustion detecting sensor 6 for detecting that sheets in the inserter 4 are exhausted are mounted in the inserter. Data detected by the sensors are reported to the image forming device 1.

In the sheet handling device 2 of the embodiment, two inserters 4 can be mounted. Hereinafter, description will be made with focusing on only one inserter 4.

Next, the saddle-stitching and folding process and the passing process which use the inserter 4 will be described.

In the saddle-stitching and folding process, when a sheet is fed from the inserter 4, the sheet fed from the inserter 4 is inserted at the sheet junction 8 into sheets transported from the image forming device 1, and then transported to the stacking tray 3. In the stacking tray 3, therefore, the sheet is stitched together with the sheets transported from the image forming device 1 to be formed as a booklet. At this time, the image forming device 1 feeds sheets from a sheet housing section 7 in consideration of the insertion of the sheet fed from the inserter 4. Usually, a sheet which is to be used as a cover of a booklet that is saddle-stitched and folded is housed in the inserter 4, and then inserted into sheets transported from the image forming device 1, at a timing when the sheet can be used as a cover of a booklet, thereby producing a booklet.

In the passing process, when a sheet is fed from the inserter 4, the sheet fed from the inserter 4 is inserted at the sheet junction 8 into sheets transported from the image forming device 1, and then transported to the post processing apparatus 16. When special sheets such as colored sheets are housed in the inserter 4, therefore, sheets loaded in the post processing apparatus 16 are partitioned by the sheets fed from the inserter 4. Hereinafter, the process of inserting a sheet(s) fed from the inserter 4 into sheets to partition the sheets during the passing process is referred to as "sheet inserting process".

In the case where the saddle-stitching and folding process and the sheet inserting process which use the inserter 4 are to be continuously conducted, in the state where the sheet residual amount detecting sensor 5 detects that the number of sheets in the inserter 4 is larger than a predetermined number, the image forming device 1 is controlled so that the intervals between the sheets fed from the inserter 4 and the sheets continuously fed from the sheet housing section 7 are set to be as small as possible, thereby improving the productivity. After the sheet residual amount detecting sensor 5 detects that the number of sheets in the inserter 4 is smaller than the predetermined number, the image forming device 1 changes the timing of transporting a sheet in the image forming device 1 so that, after the sheet exhaustion detecting sensor 6 confirms that sheets remain in the inserter 4, the sheet supply from the sheet housing section 7 is conducted. As a result, a phenomenon in which sheets remain in the image forming device 1 even after there is no sheet in the inserter 4 does not occur.

The above-described configuration will be specifically described with reference to the timing charts of FIGS. 2 and 3.

Figure 2:
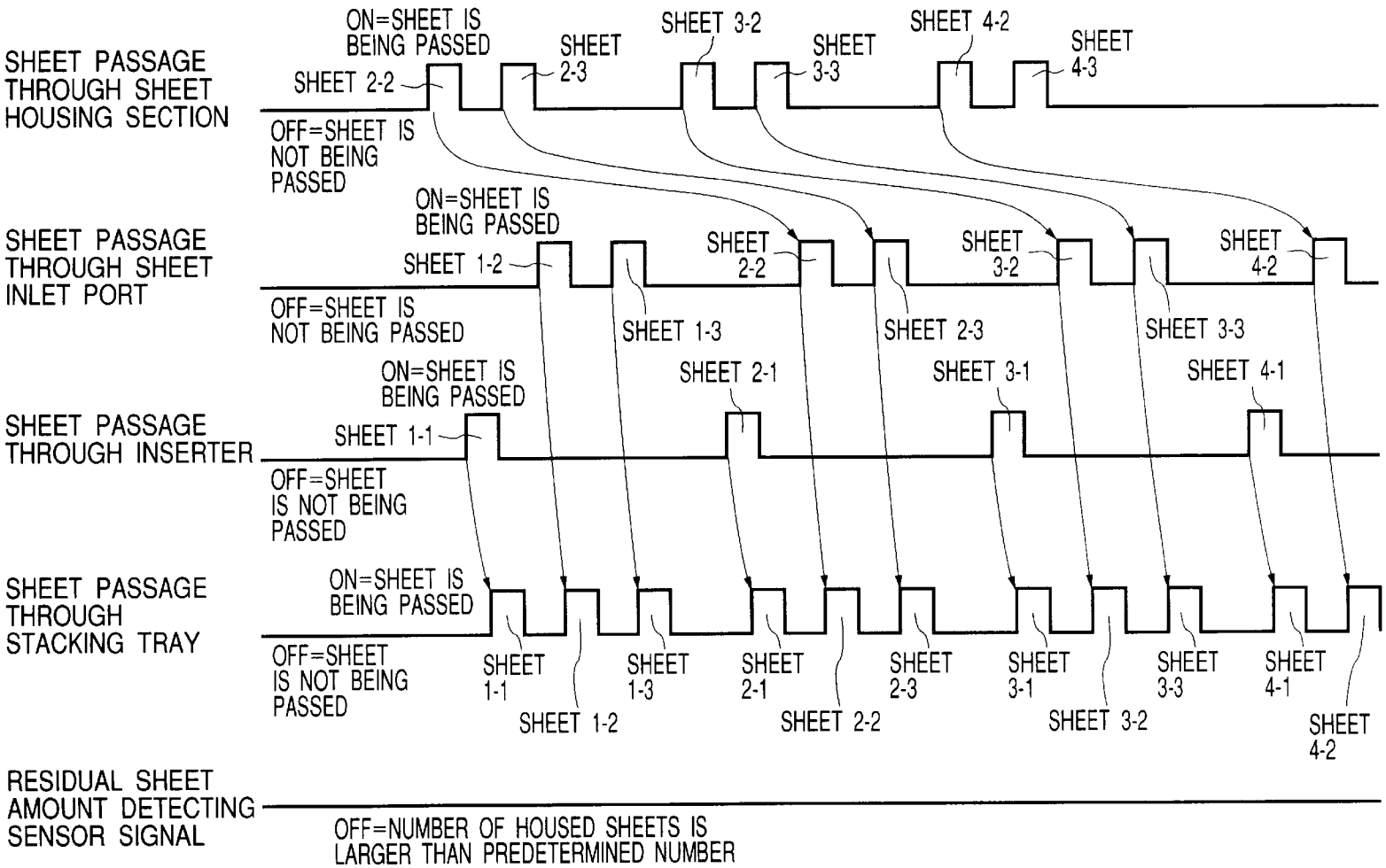
FIG. 2 is a timing chart showing the saddle-stitching and folding process in the embodiment of the invention in the case where the number of sheets housed in an inserter is larger than a predetermined number.
Figure 3:
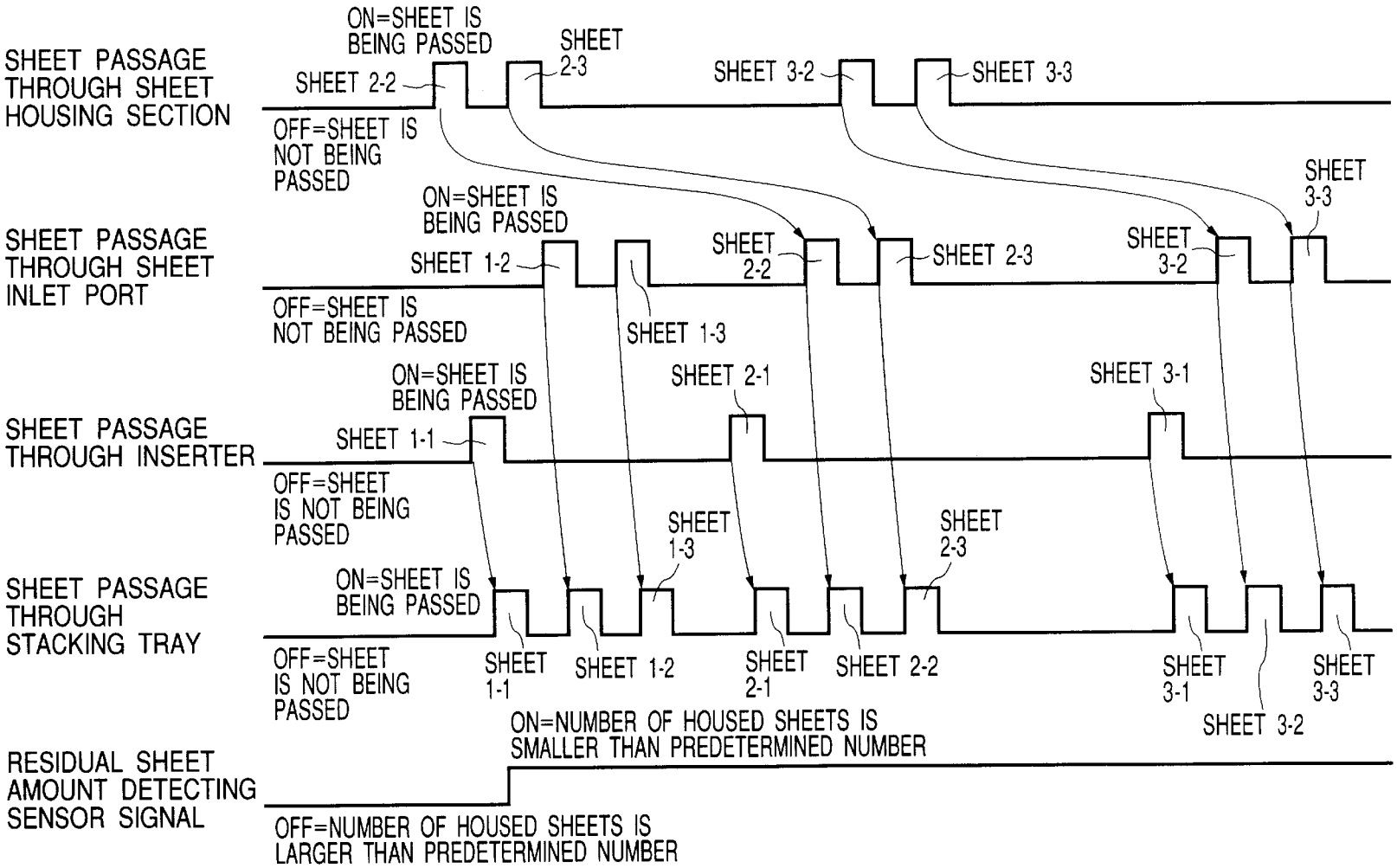
FIG. 3 is a timing chart showing the saddle-stitching and folding process in the embodiment of the invention in the case where the number of sheets housed in the inserter is smaller than the predetermined number.

FIGS. 2 and 3 show a process of producing a plurality of booklets by: feeding a sheet which will be used as the first sheet of each of the booklets, from the inserter 4; feeding sheets which will be used as the second and third sheets of the booklet, from the image forming device 1; and joining these sheets together and conducting the saddle-stitching and folding process to form a booklet of three sheets. In the figures, each of the lines of the sheet passage through the sheet housing section show sheet passage through the sheet inlet port, through the inserter, and through the stacking tray shows. In the OFF state, a sheet is not being passed through the corresponding section, and, in the ON state, a sheet is passed through the corresponding section. In the signal of the sheet residual amount detecting sensor, OFF indicates that the number of sheets housed in the inserter 4 is larger than the predetermined number, and ON indicates that the number of sheets housed in the inserter 4 is smaller than the predetermined number.

FIG. 2 is a timing chart of the state where the sheet residual amount detecting sensor 5 detects that the number of sheets housed in the inserter 4 is larger than the predetermined number.

In the case of FIG. 2, the image forming device 1 feeds a sheet 1-2 which will be used as the second sheet of the first booklet, and a sheet 1-3 which will be used as the third sheet, from the sheet housing section 7. The sheets 1-2 and 1-3 are transported to the sheet handling device 2. The sheet handling device 2 feeds a sheet 1-1 from the inserter 4, before the sheets 1-2 and 1-3 are transported to the stacking tray 3. Therefore, the sheet 1-1, the sheet 1-2, and the sheet 1-3 are transported in this sequence to the stacking tray 3. The saddle-stitching and folding process is conducted on the three sheets, so that a booklet in which the sheet 1-1 fed from the inserter 4 is used as the first sheet of the booklet is produced.

During a period when the first booklet is produced, the image forming device 1 feeds a sheet 2-2 which will be used as the second sheet of the second booklet, and a sheet 2-3 which will be used as the third sheet, from the sheet housing section 7. When the first booklet is transported from the stacking tray 3 to the folding machine 14, the inserter 4 feeds a sheet 2-1 which will be used as the first sheet of the second booklet, and the sheet is then transported to the stacking tray 3. In succession, the sheet 2-2 which will be used as the second sheet of the second booklet, and the sheet 2-3 which will be used as the third sheet are transported to the stacking tray 3, and the saddle-stitching and folding process is conducted to produce the second booklet.

As described above, in the state where the sheet residual amount detecting sensor 5 detects that the number of sheets housed in the inserter 4 is larger than the predetermined number, during a period when a certain booklet is produced by the sheet handling device 2, the image forming device 1 feeds sheets which will constitute the next booklet, from the sheet housing section 7.

FIG. 3 is a timing chart of the case where, when a sheet 1-1 which will be used as the first sheet of the first booklet is fed from the inserter 4, the sheet residual amount detecting sensor 5 detects that the number of sheets is smaller than the predetermined number.

Referring to FIG. 3, in the case where the sheet residual amount detecting sensor 5 is turned ON when the sheet 1-1 is fed from the inserter 4, the image forming device 1 feeds a sheet 2-2 which will be used as the second sheet of the second booklet that is currently being processed, and a sheet 2-3 which will be used as the third sheet, from the sheet housing section 7 in the same manner as the case before the sheet residual amount detecting sensor 5 is turned ON. However, the image forming device does not feed a sheet 3-2 which will be used as the second sheet of the subsequent or third booklet, but starts the operation of feeding the sheet 3-2 for the third booklet. When the sheet 2-1, which will be used as the first sheet of the second booklet, is fed from the inserter 4, the sheet exhaustion detecting sensor 6 confirms that a sheet 3-1 will be used as the first sheet of the third booklet is in the inserter 4.

According to the invention, it is possible to provide a stable printing apparatus in which, even when sheets in an inserter are exhausted, no sheet remains in an image forming device, and a wasteful use of sheets due to removal of sheets and a labor due to reprinting can be eliminated.

What is claimed is:

1. A printing apparatus comprising:

an image forming device; and a sheet handling device connected to a downstream side in a sheet transporting direction of said image forming device and having at least one sheet feeding apparatus, wherein said sheet handling device comprises a sheet residual amount detecting sensor and a sheet exhaustion detecting sensor, and in said image forming device, a timing of transporting a sheet to said sheet handling device is changed in accordance with a detection signal from said sheet residual amount detecting sensor, and wherein said sheet residual amount detecting sensor detects that a residual number of sheets is smaller than a predetermined number.

2. The printing apparatus according to claim 1, wherein the timing of transporting a sheet from said image forming device to said sheet handling device is set so that, when said sheet residual amount detecting sensor detects that a the residual number of sheets is smaller than a the predetermined number, said image forming device transports a sheet after a sheet transported from said sheet feeding apparatus disposed in said sheet handling device reaches a predetermined position.

3. The printing apparatus according to claim 1, wherein the timing of transporting a sheet from said image forming device to said sheet handling device is set so that the image forming device transports a sheet, after a sheet transported from said sheet feeding apparatus disposed in said sheet handling device reaches a predetermined position.

4. The printing apparatus according to claim 1, further comprising:

a controller operatively coupled to said image forming device; and a sheet housing section operably connected to said image forming device, wherein, when said sheet residual amount detecting sensor detects that a number of sheets in said sheet feeding apparatus is larger than a predetermined number, said controller controls said image forming device so that timing intervals between said sheets fed from said sheet feeding apparatus and said sheets fed from said sheet housing section are set to a predetermined small time period.

5. The printing apparatus according to claim 1, further comprising:

a stacking tray coupled to said sheet handling device, wherein a sheet fed from said sheet feeding apparatus is attached to a plurality of sheets transported from said image forming device to form a booklet.

6. A printing apparatus comprising:

an image forming device;

a sheet handling device connected to a downstream side in a sheet transporting direction of said image forming device and having at least one sheet feeding apparatus, wherein said sheet handling device comprises a sheet residual amount detecting sensor and a sheet exhaustion detecting sensor, and in said image forming device, a timing of transporting a sheet to said sheet handling device is changed in accordance with a detection signal from said sheet residual amount detecting sensor;

a stacking tray coupled to said sheet handling device, wherein a sheet fed from said sheet feeding apparatus is attached to a plurality of sheets transported from said image forming device to form a booklet; and a folding machine operably coupled to said sheet handling device and being positioned downstream of said stacking tray, wherein a booklet transported from said stacking tray to said folding machine is fed with a sheet from said sheet feeding apparatus.

7. A printing apparatus, comprising:

an image forming device; and a sheet handling device being positioned downstream of said image forming device, wherein a timing of transporting a sheet from said image forming device to said sheet handling device is set such that when a residual number of sheets is smaller than a predetermined number, said image forming device transports a sheet, after a sheet transported from said sheet handling device reaches a predetermined position.

8. The printing apparatus according to claim 7, further comprising:

a sheet feeding apparatus coupled to said sheet handling device; and a sheet residual amount detector operatively coupled to said sheet feeding apparatus, wherein the timing of transporting a sheet to said sheet handling device is changed in accordance with a detection signal from said sheet residual amount detector.

9. The printing apparatus according to claim 8, further comprising:

a sheet housing section operably coupled to said image forming device, wherein said sheet housing section feeds sheets into said image forming device; and a controller operatively coupled to said image forming device, wherein, when said sheet residual amount detector detects that a number of sheets in said sheet feeding apparatus is larger than a predetermined number, said controller controls said image forming device so that timing intervals between said sheets fed from said sheet feeding apparatus and said sheets fed from said sheet housing section are set to a predetermined small time period.

10. The printing apparatus according to claim 9, wherein said sheet handling device comprises a sheet stacking tray, and wherein said sheet stacking tray receives sheets from said sheet feeding apparatus through an inlet port transporting path prior to said sheet entering said stacking tray.

11. The printing apparatus according to claim 9, wherein said sheet feeding apparatus further comprises a sheet exhaustion detector, and wherein said exhaustion detector detects that sheets in said sheet feeding apparatus are exhausted.

12. The printing apparatus according to claim 9, further comprising:

a stacking tray coupled to said sheet handling device, wherein a sheet fed from said sheet feeding apparatus is attached to sheets transported from said image forming device to form a booklet.

13. The printing apparatus according to claim 8, wherein said sheet residual amount detecting sensor detects when an amount of loaded sheets becomes approximately 10% or less.

14. A process for producing printed sheets in a printing apparatus, comprising:

transporting a sheet from an image forming device to a sheet handling device;

detecting that a residual number of sheets in said sheet handling device is smaller than a predetermined number;

timing said transporting of said sheet from said image forming device to said sheet handling device when said residual number of sheets is smaller than said predetermined number; and transporting a sheet in said image forming device after a sheet transported from said sheet handling device reaches a predetermined position.

15. The process according to claim 14, further comprising:

detecting that sheet supply in said sheet handling device is exhausted.

16. The process according to claim 14, further comprising:

feeding a plurality of sheets into said image forming device from a sheet feeding apparatus within said image forming device; and controlling said image forming device so that timing intervals between said sheets fed from said sheet feeding apparatus and said sheets fed from a sheet housing section are set to a predetermined small time period.

17. The process according to claim 14, further comprising:

attaching a sheet transported from said image forming device with sheets fed from a sheet feeding apparatus to form a booklet.

18. The process according to claim 14, wherein said detecting of said residual number of sheets in said sheet handling device is provided by a sensor in a sheet feeding apparatus of said sheet handling device.

19. The process according to claim 14, further comprising:

controlling said image forming device such that no sheets remain in said image forming device when sheets are exhausted from a sheet feeding apparatus in said sheet handling device.

* * * * *